United States Patent [19]

Koyama

[11] Patent Number: 4,491,817

[45] Date of Patent: Jan. 1, 1985

[54] SHEET-WOUND TRANSFORMER

[75] Inventor: Yoshio Koyama, Kawasaki, Japan

[73] Assignee: Tokyo Shibaura Denki Kabushiki Kaisha, Kawasaki, Japan

[21] Appl. No.: 585,504

[22] Filed: Mar. 2, 1984

[30] Foreign Application Priority Data

Mar. 3, 1983 [JP] Japan ..... 58-33794

[51] Int. Cl.[3] ..... H01F 27/08

[52] U.S. Cl. ..... 336/60

[58] Field of Search ..... 336/55, 57, 58, 60, 336/223, 232, 185; 174/15 R

[56] References Cited

U.S. PATENT DOCUMENTS

| | | | |
|---|---|---|---|
| 2,912,658 | 11/1959 | Paluev | 336/60 X |
| 3,032,728 | 5/1962 | Camilli et al. | 336/60 |
| 3,056,071 | 9/1962 | Baker et al. | 336/60 X |
| 4,039,990 | 11/1977 | Philp | 336/60 |

FOREIGN PATENT DOCUMENTS

| | | | |
|---|---|---|---|
| 888518 | 12/1943 | France | 336/58 |

OTHER PUBLICATIONS

J. R. Morris et al., "A New Concept for a Compressed Gas-Insulated Power Transformer, *IEEE/PES Transmission and Distribution Conference and Exposition,* (Apr. 1979).

W. J. McNutt et al., "Technology Development for Advanced Concepts in Gas-Insulated Power Transformers, *IEEE/PES Transmission and Distribution Conference and Exposition,* (Apr. 1979).

*Primary Examiner*—Thomas J. Kozma

*Attorney, Agent, or Firm*—Schwartz, Jeffery, Schwaab, Mack, Blumenthal & Koch

[57] ABSTRACT

A sheet-wound transformer comprises a magnetic core, a number of coil windings formed of sheet conductors wound around the magnetic core, and a plurality of cooling panels inserted in the coil windings. A number of ribs are provided in each cooling panel so as to extend in parallel with each other for guiding the flow of a coolant therethrough. Leading and trailing ends of the ribs are located respectively on two lines, the inclination of each line being varied between the central portion and end portions thereof, so that the displacement between two ends of adjacent pair of ribs located on an end portion of the line is made larger than the displacement between two ends of ribs located on the central portion of the line.

3 Claims, 6 Drawing Figures

SHEET-WOUND TRANSFORMER

BACKGROUND OF THE INVENTION

This invention relates to a sheet-wound transformer in which sheet conductors are wound into coils of required turns with an insulating sheet interposed between adjacent turns and cooling panels are provided at desired positions in the coils.

It is widely known that sheet-wound transformers are advantageous because the space factor of the conductors, that is, the ratio of the space occupied by the sheet conductors within the coils can be selected to a large value, and hence, the size and weight of the transformer can be substantially smaller than those of a conventional wire-wound transformer. However, in an application of high voltage and large capacity, it is essential to improve the cooling capability and assuring a high insulation. For this purpose, the transformer is provided with a plurality of cooling panels through which a coolant is circulated so that the heat generated in the conductors can be removed directly out of the conductors.

A sheet-wound transformer of a conventional construction comprises a magnetic core and a low-voltage coil and a high-voltage coil wound around the magnetic core with a sheet of insulating material interposed between each adjacent turns of the sheet conductor. The transformer further comprises a plurality of cooling panels each made into a hollow substantially rectangular construction wound or bent into an arcuate configuration. Inlet and outlet pipes are connected to appropriate portions of the panel for circulating a coolant therethrough. A plurality of spacers or ribs are provided in each panel for maintaining a proper spacing between the walls of the panel for coolant flow. Void space internally of the transformer tank is filled with an insulation gas such as $SF_6$.

With the above described construction of the sheet-wound transformers, however, due to leakage magnetic fluxes, eddy currents have been generated at the upper and lower end portions (widthwise end portions) of the sheet conductors in the same direction as the load current, so that the current density at the portions is increased to a value more than seven times larger than the average value. This implies that Joule heat generated per unit time and unit volume of the conductor at these portions is approximately 50 times larger than the average value. However, due to the heat conduction in the axial direction (widthwise direction), the amount of heat to be removed (or cooled) out of the end portions is reduced to three times of the average value.

In the conventional construction of the sheet-wound transformers, since the ribs or spacers provided in each panel have been distributed evenly in parallel with each other with the leading ends and trailing ends thereof being aligned vertically. Thus the heat generated in the end portions of the conductor cannot be dissipated effectively, and local temperature rise in these portions could not be prevented.

SUMMARY OF THE INVENTION

A primary object of the present invention is to provide a sheet-wound transformer wherein the heat generated by eddy currents in the coil end portions can be removed effectively, and local temperature rise at those portions can be substantially eliminated.

Another object of the present invention is to provide a sheet-wound transformer wherein cooling of the sheet conductors can be effectuated emphatically at the widthwise end portions regardless of a simple construction of the cooling panel.

These and other objects of the present invention can be achieved by a sheet-wound transformer comprising a magnetic core, a number of coil windings made of sheet conductors wound around the magnetic core with insulating sheet interposed between adjacent winding turns, a plurality of cooling panels inserted in the coil windings in which a coolant flows, and a number of ribs provided in each of the cooling panels so as to extend in parallel with each other in a direction of winding the sheet conductors, wherein either of leading and trailing ends of the ribs, when interconnected, form a line having an inclination varied in a direction perpendicular to the winding direction such that a displacement between two adjacent rib ends located on either one of end portions of the line becomes larger than a displacement between those located on a central portion of the line.

BRIEF DESCRIPTION OF THE DRAWINGS

In the accompanying drawings

DESCRIPTION OF THE PREFERRED EMBODIMENTS

Before entering the detailed description of the present invention, a conventional sheet-wound transformer will now be described with reference to FIGS. 1–4 for sufficient understanding of the present invention.

Figure 1:
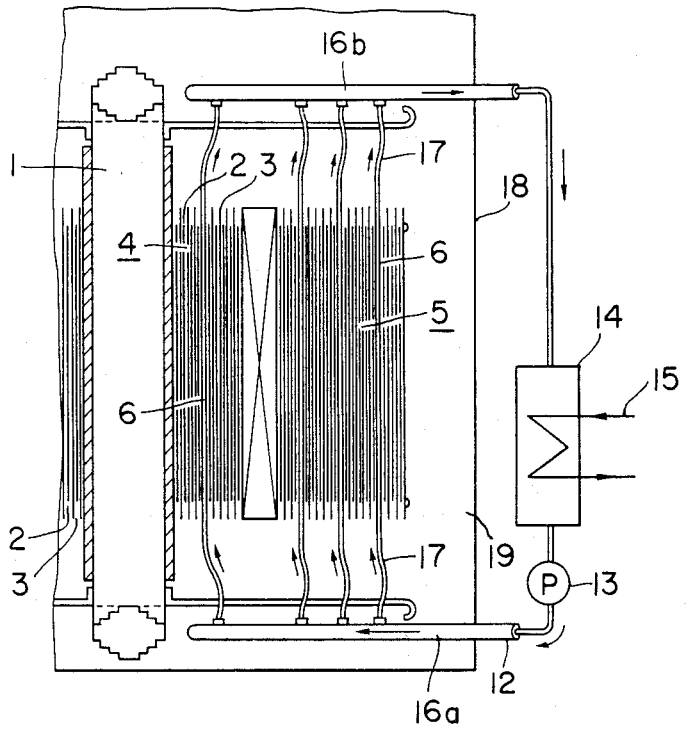
FIG. 1 PRIOR ART
FIG. 1 is a vertical sectional view showing a construction of a conventional sheet-wound transformer.
Figure 2:
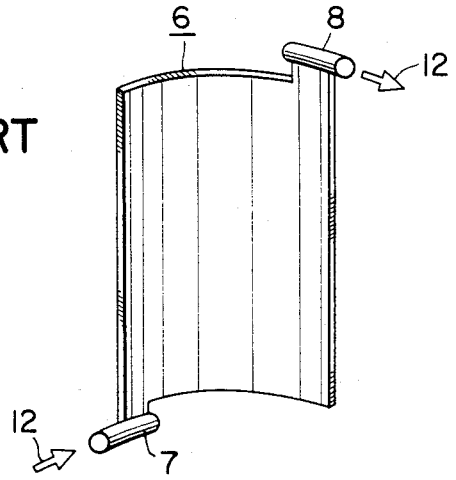
FIG. 2 PRIOR ART
FIG. 2 is a perspective view showing a cooling panel utilized in the conventional transformer shown in FIG. 1.
Figure 3:
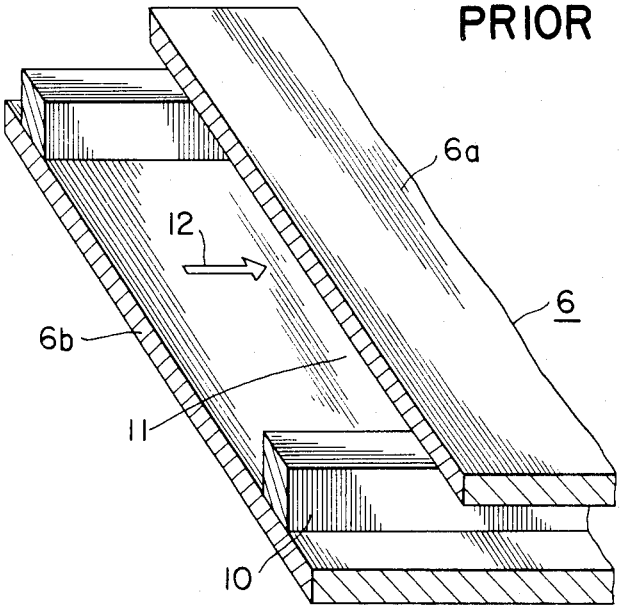
FIG. 3 PRIOR ART
FIG. 3 is an enlarged perspective view showing a part of the cooling panel illustrated in FIG. 2.

As generally illustrated in FIG. 1, the conventional transformer comprises a magnetic core 1 typically of a laminated construction, a low-voltage coil 4 wound around the magnetic core 1, and a high-voltage coil 5 wound around the low-voltage coil 4. Each of the coils 4 and 5 is made of a sheet conductor 2 wound around as described above in a required number of turns with an insulating sheet 3 interposed between adjacent turns of the coil. A plurality of cooling panels 6 of a hollow construction of an arcuate or cylindrical shape as viewed from the top in FIG. 1 are provided at required positions in each of the coils 4 and 5. A coolant supplying pipe 7 and a coolant exhausting pipe 8 are connected to the inlet and outlet portion of the panel 6 as shown in FIG. 2. Furthermore, as shown in FIG. 3 in more detail, each panel 6 includes a plurality of spacers or ribs 10 which maintain a narrow spacing 11 between side walls **6*a* and 6*b* of the panel 6. The coolant supplying pipe 7 and coolant exhausting pipe 8 are further connected through insulating pipes 17 to a coolant supplying manifold 16*a* and a coolant exhausting manifold 16*b*, respectively, as shown in FIG. 1. A pump 13 and a cooler 14** provided outside of the transformer are connected between the manifolds 16*a* and 16*b*. The pump 13 circulates a coolant 12 such as Freon 113 (made by DuPont de Nemours Co.) or FC-75 (made by Minnesota Mining Co.) through the cooling panels for removing Joule heat out of the sheet conductors 2. The coolant 12 passed through the panels 6 and having a temperature higher than the initial value is cooled in the cooler 14 by water 15 and sent back through the coolant supplying manifold 16*a* to the cooling panels 6.

The coolant supplying manifold 16*a* and the coolant exhausting manifold 16*b* are made of a metal such as stainless steel. However, since the insulating pipes 17 are inserted between the cooling panels 6 and the manifolds, the manifolds as well as a tank 18 encasing the sheet-wound coils are maintained at the earth potential.

On the other hand, the cooling panels 6 provided within the coil windings are at the potential of the adjacent sheet conductor, and the insulation between the high voltage part and the low voltage part of the transformer is assured by an insulating gas 19 such as $SF_6$. Lead wires and bushings of the transformer are omitted in the drawings for simplifying the illustration.

The sheet-wound transformer of the type described above is termed a separate type transformer because the coolant circuit is completely separated from the insulating gas 19. Such a transformer is advantageous because of reduced size and weight and high insulation reliability. However, this type transformer has revealed difficulties of presenting a high current density and a local temperature rise as described above at the upper and lower end portions of the sheet-wound coils, as viewed in FIG. 1, because of eddy currents flowing in the conductors. Since the ribs in the cooling panels 6 of the conventional transformer are arranged in vertical alignment as designated by reference numeral 20 in FIG. 4, the coolant 12 is thereby guided to flow substantially evenly through the cooling panels 6, and hence local temperature rise of the sheet-wound coils could not be avoided.

Figure 4:
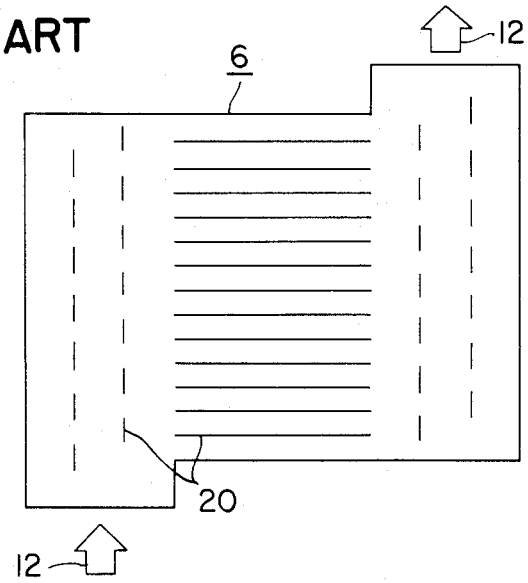
FIG. 4 PRIOR ART
FIG. 4 is a diagram showing an arrangement of ribs provided in the cooling panel of the conventional transformer.
Figure 5:
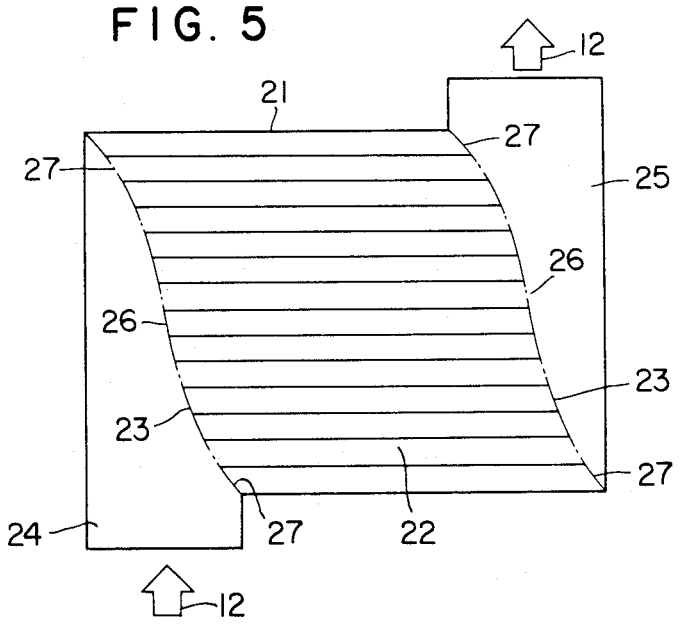
FIG. 5 is a diagram showing an arrangement of ribs in a cooling panel provided in a sheet-wound transformer according to the present invention.

FIG. 5 illustrates a preferred embodiment of the present invention, wherein each cooling panel 21 also formed into an arcuate shape or a cylindrical shape and inserted among the sheet-wound coils is provided with ribs 22 that extend in parallel with each other from the inlet end to the outlet end of the panel 21. According to the present invention, the inlet-side ends and the outlet-side ends of the ribs 22 are not aligned vertically as shown in FIG. 4, but are disposed obliquely. More specifically, imaginary lines 23 that connect the inlet and outlet ends of the ribs 22 are inclined so as to define a wedge-like coolant distributing portion 24 and a wedge-like coolant collecting portion 25 respectively. Furthermore, the inclination of the imaginary lines is made different between the central portion 26 and the upper and lower end portions 27 thereof, so that the displacement between two ends of adjacent pair of ribs located on the upper and lower portions of the line is made larger than that between the ends of the ribs located on the central portion of the line.

With the above described arrangement of the ribs in the cooling panel 21, a larger part of the coolant supplied into the panel is guided by the ribs so as to flow through the upper and lower portions of the panel, and the aforementioned local temperature rise of the sheet conductors can be thereby eliminated.

Figure 6:
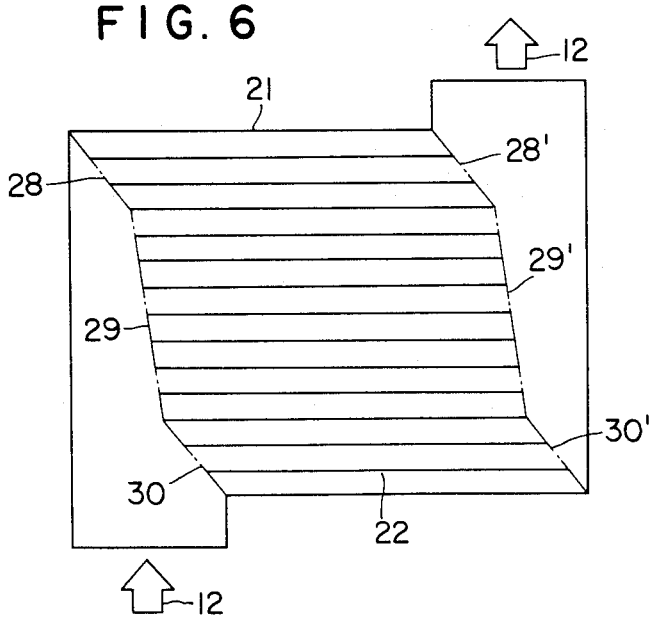
FIG. 6 is a diagram showing another arrangement of ribs in a cooling panel according to the present invention.

In another preferred embodiment shown in FIG. 6, the ribs 22 provided in the cooling panel 21 are arranged in such a manner that each imaginary line connecting the inlet or outlet ends of the ribs 22 are made of three straight lines 28, 29, 30 (or 28′, 29′, 30′) with the inclination of the lines 28 and 30 (or 28′ and 30′) in the upper and lower portions of the panel 21 being selected to be larger than that of the line 29 (or 29′) in the central portion. This embodiment exhibits advantages substantially equal to those of the embodiment shown in FIG. 5.

What is claimed is:

1. A sheet-wound transformer comprising:

a magnetic core;

a number of coil windings made of sheet conductors wound around said magnetic core with insulating sheet interposed between adjacent winding turns;

a plurality of cooling panels inserted in the coil windings in which a coolant flows; and a number of ribs provided in each of the cooling panels so as to extend in parallel with each other in a direction of winding the sheet conductors, either of leading and trailing ends of said ribs forming a line, when interconnected, which has an inclination varied in a direction perpendicular to the winding direction such that a displacement between two adjacent rib ends located on either one of end poritons of said line becomes larger than a displacement between those located on a central portion of said line.

2. A sheet-wound transformer as set forth in claim 1 wherein said lines formed by interconnecting the leading and trailing ends of the ribs constitute continuous curved lines, respectively.

3. A sheet-wound transformer as set forth in claim 1 wherein said lines formed by interconnecting the leading and trailing ends of the ribs have a plurality of, at least, three straight line portions.

* * * * *